United States Patent [19]

Burger et al.

[11] 4,227,905

[45] Oct. 14, 1980

[54] PROCESS AND HEAT PUMP FOR THE TRANSFER OF HEAT AND COLD

[76] Inventors: Manfred Burger, Wolfratshauser Strasse 45, 8023 Pullach; Waldeman Dukek, Landsberger Strasse 161, 8000 Müchen; Ernst Gagel, Karwendelstrasse 49, 8000 Müchen 70; Alfred Pretchtl, Lindenweg 6, 8082 Grafrath; Rudolf Kalmovicz, Stadtweg 25, 8059 Altenerding, all of Fed. Rep. of Germany

[21] Appl. No.: 899,619

[22] Filed: Apr. 24, 1978

[30] Foreign Application Priority Data

Apr. 25, 1977 [DE] Fed. Rep. of Germany ..... 2718265

[51] Int. Cl.[2] ..... F25B 41/00; F25B 27/02; F25B 47/00; F25B 31/00

[52] U.S. Cl. ..... 62/113; 62/277; 62/238; 62/505; 62/513

[58] Field of Search ..... 62/113, 115, 238 F, 62/505, 277, 513; 165/62

[56] References Cited

U.S. PATENT DOCUMENTS

| | | | |
|---|---|---|---|
| 2,125,842 | 8/1938 | Eggleston | 62/238 E |
| 2,608,834 | 9/1952 | McClog | 62/513 |
| 3,057,172 | 10/1962 | Ditzler | 62/505 |
| 3,112,618 | 12/1963 | Weller | 62/505 |
| 3,188,829 | 6/1965 | Siewert et al. | 62/238 E |
| 3,192,735 | 7/1965 | Bernhard | 62/505 |
| 3,315,481 | 4/1967 | Check et al. | 62/115 |
| 3,513,663 | 5/1970 | Martin, Jr. et al. | 62/238 E |
| 3,926,008 | 12/1975 | Webber | 62/238 E |

*Primary Examiner*—Lloyd L. King
*Attorney, Agent, or Firm*—Pollock, Vande Sande & Priddy

[57] ABSTRACT

Apparatus and method for improving the efficiency of a heat pump for transferring heat and cold between two separate fluid streams, in which, during heating operation, the cooling medium is heated before decompression by the Joule's heat released upon compression. According to a preferred embodiment, prior to this heating by Joule's heat, the cooling medium is cooled by heat exchange with the fluid stream used for evaporation, which fluid stream is simultaneously heated.

5 Claims, 3 Drawing Figures

PROCESS AND HEAT PUMP FOR THE TRANSFER OF HEAT AND COLD

This invention relates to a process for the transfer of heat and cold between two separate fluid streams by means of a closed circulate of cooling medium by which the cooling medium is successively evaporated, compressed, liquefied and decompressed and, by heat exchange with the fluid streams, absorbs the heat of evaporation and gives up the heat of condensation, and to a heat pump for carrying out this process.

Various forms of heat pumps are known, in particular also as combined heating and cooling apparatus. In some of these combined apparatuses, the operation is switched from heating to cooling and conversely by reversing the circulation of cooling medium, while in others this is effected by reversing two separate fluid streams which are formed, for example, by external air and by internal air inside a building and which are selectively brought into heat exchange with either the evaporator or the condenser of the cooling circulate. The invention relates particularly but not exclusively to the last mentioned form of apparatus. References to the state of the art may be found in the applicants' own German Offenlegungsschrift No. 2,542,728.

In heating pumps, particularly those used predominantly for heating purposes, it is desirable, for the sake of economy in energy consumption, to achieve a high degree of efficiency, i.e., a high ratio of heating power to electrical energy consumed for driving the compressor and auxiliary parts.

It is an object of this invention to improve this efficiency coefficient of a heat pump.

In a process according to the invention, the solution to this problem consists in that, when the apparatus is to be operated for heating, the cooling medium is heated before decompression by the Joule's heat released on compression.

This measure increases the temperature of the cooling medium upstream of the restrictor valve and in the evaporator. The specific heat required for evaporating the cooling medium is therefore reduced, so that the throughput of cooling medium can be increased. This increased rate of throughput results in an increased release of heat in the condenser. These relationships will be explained in more detail below with reference to examples.

The Joule's heat released by a compressor is in all cases sufficient for the heat required in the circulation of cooling medium, as will be explained hereinafter.

According to a preferred embodiment of this invention, the circulating cooling medium is cooled by heat exchange with the fluid stream used for evaporation before it is heated by the Joule's heat of the compressor, and the fluid stream is heated at the same time. Due to this heating of the fluid stream, a larger quantity of heat is available in the evaporator for evaporating the cooling medium.

The heat pump according to the invention comprises an evaporator, a compressor, a condensor and a restrictor valve and is characterised in that the compressor has a cooling jacket with an inlet and an outlet and in that the outlet and inlet are interconnected by branch pipes which branch off from the cooling medium circuit one after the other upstream of the restrictor valve and enable the circulation of cooling medium to be diverted. In order that the invention may be more clearly understood, reference will now be made to the accompanying drawing, wherein several embodiments are shown for purposes of illustration, and wherein:

Figure 1:
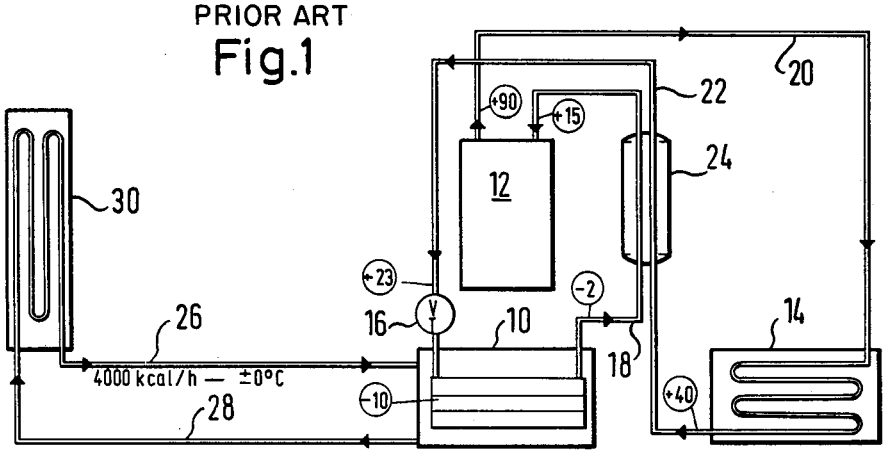
PRIOR ART Fig.1
FIG. 1 is a schematic circuit diagram of a conventional heat pump.

FIG. 1 represents a cooling medium circuit, comprising an evaporator 10, a compressor 12, a condensor 14 and a restrictor valve 16 all joined together by pipes 18, 20 and 22 to form a closed circuit. The restrictor valve 16 is situated substantially immediately upstream of the evaporator 10.

Pipes 18 and 22 leaving the evaporator 10 and condensor 14, respectively, both pass through a known heat exchanger 24 which carries out a so-called internal heat exchange with the cooling medium circuit.

It is assumed for the purpose of this description that the cooling medium circuit is installed inside a building which is to be air conditioned. In the illustrated heating system, the evaporator 10 communicates through pipes 26, 28 with a heat exchanger 30 heat exchanger which heat exchanger exchanges heat with the surrounding air outside the building and transfers its heat to a transfer liquid, for example a brine, which circulates in the pipes 26, 28, the heat exchanger 30 and the evaporator 10. Further details may be found in the applicants' above mentioned German Offenlegungsschrift No. 2,542,728.

The arrows in the pipes shown in FIG. 1 represent the direction of circulation of cooling medium and of brine.

Figure 2:
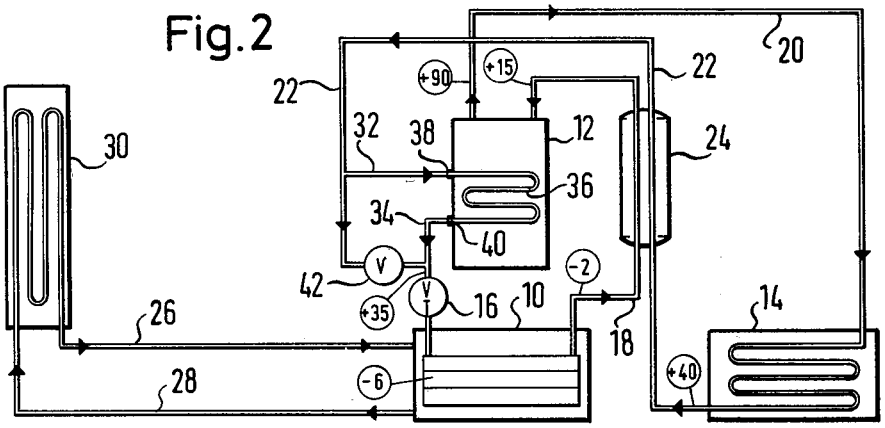
FIGS. 2 and 3 are two circuit diagrams of heat pumps according to the invention.

The parts shown in FIG. 2 are substantially the same as in FIG. 1 and are therefore identified by the same reference numerals. The only difference between this embodiment according to the invention and the construction represented in FIG. 1 is that, in FIG. 2, the pipe 22 leaving the condenser 14 and entering the restrictor valve 16 is connected to two branch pipes 32, 34 upstream of the valve 16, which branch pipes 32, 34 are connected at their other ends to the inlet 38 and outlet 40 of a cooling jacket 36 (not shown) of the compressor 12. Compressors equipped with such cooling jackets are known and are therefore not described here. That section of the pipe 22 which is situated between pipes 32 and 34 contains a shut-off valve 42. When valve 42 is closed, the cooling medium is forced through the pipe 32, the cooling jacket 36 and the pipe 34 so that it undergoes heat exchange with the compressor 12 and can absorb the Joule's heat from this compressor. The mode of operation of this arrangement will be described in more detail hereinbelow.

Figure 3:
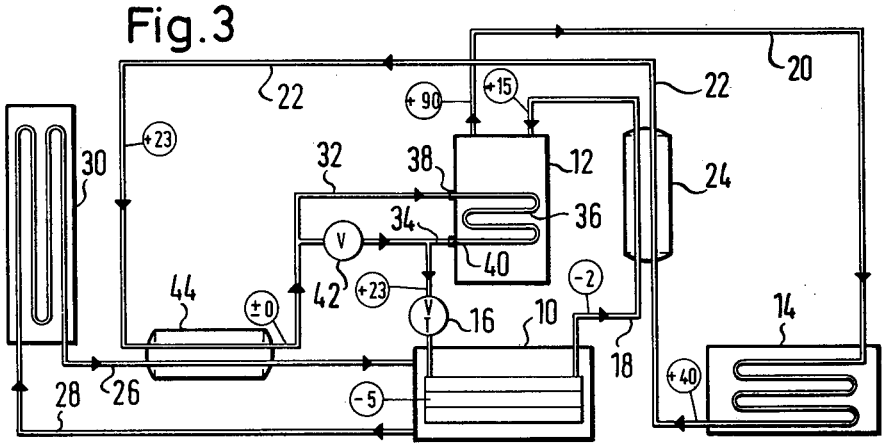

FIG. 3 represents another improved embodiment of the invention, in which the main parts are again similar to those of FIG. 1 and to some of the parts of FIG. 2, and are accordingly marked with the same reference numerals.

The only difference between the embodiment represented in FIG. 3 and that shown in FIG. 2 is that in FIG. 3 the pipe 22 of the cooling medium circuit passes through a heat exchanger 44 after leaving the condenser 14, which heat exchanger effects exchange of heat between the pipe 22 and the stream of fluid in pipe 26 which carries, for example, brine from the external heat exchanger 30 to the evaporator 10. The temperature of the cooling medium is thereby lowered and that of the brine raised.

The thermodynamic aspects of this measure will be discussed later. The compressor 12 is in this case also provided with a cooling jacket 36. When the shut-off valve 42 is closed, cooling medium flows from the heat exchanger 44 through the cooling jacket 36 of the compressor and is heated therein before it passes through the restrictor valve 16 to be injected into the evaporator 10.

In the embodiments of the invention illustrated in FIGS. 2 and 3, the shut-off valve 42 is closed only during heat operation of the system and is kept open during cooling so that during the cooling operation the cooling medium flows directly through the shut off valve 42 into the restrictor valve 16. When the shut off valve 42 is open, the cooling medium flows directly through it since this constitutes the path of less resistance.

The thermodynamic balance of the three heat pumps shown in FIGS. 1 to 3 will now be described with reference to an experimental example. The temperatures at the various points of the cooling medium circuit are circled in the figures. They are measured in degrees Centigrade.

In the conventional heat pump according to FIG. 1, the cooling medium in evaporator 10 is vaporized at a vaporization temperature of −10° C. and leaves the evaporator at −2° C. after a certain superheating. It is heated to 15° C. in the heat exchanger 24 and is compressed at this temperature. On leaving the compressor 12, it has a temperature of 90° C. At this temperature, it enters the condensor 14, where it is condensed and which it leaves at 40° C. It is cooled to 23° C. in the heat exchanger 24 and injected into the evaporator 10 through the restrictor valve 16.

In the embodiment according to FIG. 2, the cooling medium, after leaving the heat exchanger 24, is heated from a temperature of 23° C. to 35° C. by the heat released in the compressor 12 and is then injected. The vaporization temperature is thereby raised to −6° C. The other temperatures remain unchanged.

In this connection, it should be pointed out that a compressor has a waste heat of the order of 40 to 60%, depending on its size. This is quite sufficient for heating the cooling medium to the extent required. The compressor used for the experiments had a power of 2.2 kilowatt with a waste heat of 1.4 kilowatt or 1204 kcal.

In the embodiment according to FIG. 3, the cooling medium is cooled to ±0° C. in the heat exchanger 44 after leaving the heat exchanger 24 at 23° C., and it is then reheated to 23° C. in the compressor 12. Owing to the additional heat transmitted to the brine in pipe 26 by the heat exchanger 44, the vaporization temperature in the evaporator 10 is raised to −5° C. The other temperatures are again the same as in the previous embodiments.

Since it is an object of this invention to increase the rate of throughput of cooling medium in the evaporator 10, the rates of throughput obtained in the examples represented in FIGS. 1 to 3 will be compared below. In each example, it is assumed that 4000 kcal/h are supplied by the heat exchanger 30 at a brine temperature of ±0° C. Since only this quantity of heat of 4000 kcal/h is available for vaporization of the cooling medium in the evaporator, the throughput of cooling medium in the evaporator is a quotient of the quantity of heat supplied and the specific heat required for vaporization per unit quantity of cooling medium, as represented below:

Throughput = heat supplied/enthalpy difference on vaporization

This calculation is carried out below for the examples represented in FIGS. 1 to 3. The enthalpy values apply to the known cooling medium FRIGEN 12.

Case 1

Enthalpy before injection (23° C., liquid): 105.20 kcal/kg

Enthalpy of vaporized cooling medium (−10° C., gaseous): 135.37 kcal/kg

Enthalpy difference on vaporization:
30.17 kcal/kg

Throughput of cooling medium:

$$\frac{4000\ \text{kcal}/h}{30.17\ \text{kcal/kg}}$$

Throughput:
132.58 kg/h

Case 2

Enthalpy before injection (after heating by the compressor) (35° C., liquid):
108.02 kcal/kg Enthalpy of vaporized cooling medium (−6° C., gaseous): 135.80 kcal/kg Enthalpy difference on vaporization:
27.78 kcal/kg Throughput of cooling medium:

$$\frac{400\ \text{kcal}/h}{27.78\ \text{kcal/kg}}$$

Throughput:
143.99 kg/h

Case 3

Enthalpy before injection (after cooling in heat exchanger 44 and heating in compressor 12) (23° C., liquid):

105.20 kcal/kg Enthalpy of vaporized cooling medium (−5° C., gaseous):
135.90 kcal/kg Enthalpy difference on evaporation:
30.70 kcal/kg Throughput of cooling medium:

For calculating the throughput in this case, it must be taken into account that the evaporator is not only supplied with 4000 kcal/h of heat but that an additional supply of heat is obtained by heating of the brine in the heat exchanger 44. Since the cooling medium is cooled from 23° C. to ±0° C. in this heat exchanger 44, the brine in pipe 26 takes up the following quantity of heat:

Enthalpy of cooling medium (23° C., liquid):
105.20 kcal/kg

Enthalpy of cooling medium (±0° C., liquid): 100.00 kcal/kg Enthalpy in heat exchanger 44: 5.20 kcal/kg.

This enthalpy difference multiplied by the throughput of cooling medium in the heat exchanger 44 represents the additional quantity of heat available for vaporization in the evaporator. The throughput x is therefore represented by the following formula:

$$x = \frac{4000\ \text{kcal}/h + (5.20\ \text{kcal/kg} \cdot x\text{kg}/h)}{30.70\ \text{kcal/kg}}$$

Throughput $x \times 156.86$ kg/h.

The throughput obtained is therefore 132.58 kg/h in Case 1, 143.99 kg/h in Case 2 according to the invention and 156.86 kg/h in Case 3 according to the invention, indicating that a marked improvement over the state of the art is obtained in Cases 2 and 3, and particularly in Case 3. Since the cooling medium is liquefied under otherwise identical conditions in the condenser and gives off heat in the process, a higher throughput of cooling medium amounts to an increased release of useful heat.

When utilizing the heat of the compressor, it should be remembered that the compressor must not be cooled excessively because otherwise thermal tensions are produced between the localized cooled areas of the compressor and the warmer regions which are less accessible to the cooling liquid. On the other hand, the temperature of the cooling liquid must not be too high, because in that case no significant transfer of heat can be expected.

It is known to use the heat of the compressor for overheating the input or suction side of the compressor, but overheating considerably shortens the life of the compressor.

For this reason, it would appear particularly suitable to use the heat of the compressor as proposed by the invention.

Finally, it should be pointed out that the embodiment according to FIG. 3 may be modified to the effect that the heat exchanger 24 through which the pipes 18 and 22 pass may be omitted or at least reduced in size.

If the heat exchanger 24 is omitted, the circulation of cooling medium reaches the heat exchanger 44 at a temperature of 40° in the given example. The throughput x is then calculated according to the following modified equation:

$$x = \frac{4000\ \text{kcal}/h + 9.22\ \text{kcal/kg} \cdot x\text{kg}/h}{30.70\ \text{kcal/kg}}$$

Throughput x = 186.21 kg/h.

Since a larger quantity of heat is transmitted to the brine in pipe 26 in the heat exchanger 44, the quantity of heat available in the evaporator 10 is increased, so that the cooling medium can be vaporized with a higher throughput. To what extent this measure can be utilized for improving the throughput, if at all, or whether it can be fully utilized, depends among other things on whether the evaporator 10 effects sufficient overheating of the cooling medium to produce a stable vapor.

We claim:

1. Process for the transfer of heat and cold between two separate fluid streams by means of a closed circuit of cooling medium, by which a cooling medium is successively vaporized, compressed, liquified and decompressed and, by heat exchange with the fluid streams, absorbs heat of evaporation and gives off heat of condensation, wherein (a) during heating by a condenser, said cooling medium is heated, prior to its decompression, by the Joule's heat released upon compression, and (b) prior to said heating by said Joule's heat, said cooling medium is cooled by heat exchange with the fluid stream used for vaporization, said fluid stream being simultaneously heated.

2. Heat pump for the transfer of heat and cold between two separate fluid streams by means of a closed circuit of cooling medium comprising an evaporator, a compressor, a condenser and a restrictor valve, wherein said compressor (12) has a heat exchanger (36) with an inlet (38) and an outlet (40), said inlet and outlet being interconnected by branch pipes (32, 34) which successively branch off said cooling medium circuit (22) upstream of said restrictor valve (16), means (42) being provided in said cooling medium circuit for enabling said heat exchanger (36) of said compressor to be selectively switched into said cooling medium circuit.

3. Heat pump according to claim 2, wherein said means comprises a shut off valve (42) located between said branch pipes (32, 34) in said cooling medium circuit (22).

4. Heat pump according to claim 2, wherein said cooling medium circuit passes through a heat exchanger (44) upstream of said branch pipes (32, 34), in which heat exchanger there is a heat exchange with the fluid stream which flows through said evaporator (10) to supply the heat of evaporation.

5. Heat pump according to claim 4, wherein said heat exchange takes place with the fluid stream (26) entering said evaporator (10).

* * * * *